US007657955B1

(12) United States Patent
Alvistur et al.

(10) Patent No.: US 7,657,955 B1
(45) Date of Patent: Feb. 9, 2010

(54) NURSING PILLOW WITH PRIVACY PANELS AND INTEGRATED CARRYING CASE

(75) Inventors: Erica L. Alvistur, Chico, CA (US); Julie Weaver, Chico, CA (US)

(73) Assignee: Dominic Carter Inc., Chico, CA (US)

( * ) Notice: Subject to any disclaimer, the term of this patent is extended or adjusted under 35 U.S.C. 154(b) by 0 days.

(21) Appl. No.: 12/257,644

(22) Filed: Oct. 24, 2008

Related U.S. Application Data

(60) Provisional application No. 61/074,992, filed on Jun. 23, 2008.

(51) Int. Cl.
*B68G 5/00* (2006.01)
*A47C 20/00* (2006.01)

(52) U.S. Cl. ..... 5/655; 5/639

(58) Field of Classification Search ..... 5/655, 5/636, 485, 639
See application file for complete search history.

(56) References Cited

U.S. PATENT DOCUMENTS

| | | | | |
|---|---|---|---|---|
| D303,995 | S * | 10/1989 | Dameron | D2/728 |
| 5,090,059 | A | 2/1992 | Kahl | |
| 5,224,637 | A * | 7/1993 | Colombo | 224/159 |
| 5,469,582 | A | 11/1995 | Livingston | |
| 5,570,474 | A | 11/1996 | Berry et al. | |
| 5,893,171 | A | 4/1999 | Ries | |
| 6,038,720 | A * | 3/2000 | Matthews et al. | 5/639 |
| 6,061,854 | A | 5/2000 | Crowley | |
| 6,079,067 | A | 6/2000 | Becker et al. | |
| 6,564,408 | B2 | 5/2003 | Van Vuuren | |
| D571,596 | S | 6/2008 | Alvistur et al. | |
| 7,464,423 | B2 * | 12/2008 | Goodwin et al. | 5/655 |
| 2006/0101579 | A1 * | 5/2006 | Albers | 5/655 |

* cited by examiner

*Primary Examiner*—Peter M Cuomo
*Assistant Examiner*—Brittany M Wilson
(74) *Attorney, Agent, or Firm*—William Bodnar

(57) ABSTRACT

A nursing pillow with integrated privacy panels that provide privacy to mothers while breast feeding infants. The pillow is U-shaped having a soft filler material and a pillow case. A neck strap helps keep the pillow close to the mother. The infant is supported on the pillow and kept in close proximity to the mother's body. The pillow folds in on itself for ease of transport and storage.

11 Claims, 3 Drawing Sheets

NURSING PILLOW WITH PRIVACY PANELS AND INTEGRATED CARRYING CASE

CROSS REFERENCE TO RELATED APPLICATIONS

This application claims priority to provisional application 61/074,992 filed on Jun. 23, 2008 and incorporated by reference herein.

FIELD OF THE INVENTION

This present invention relates to nursing pillows.

BACKGROUND OF THE INVENTION

Mothers with new babies are encouraged in books, by health care professionals and by local, state and federal agencies to breastfeed (nurse) their babies. Modest, yet health conscious, mothers who choose to nurse their infants find it problematical and perhaps socially unacceptable to feed their babies in public. It is often difficult to use a small blanket for this purpose because it may often fall down and may not be convenient for positioning the baby correctly.

In addition, breastfeeding often requires the nursing mother to sit and support the child being nursed for extended periods of time. If both the mother and baby are not comfortable during nursing, the nursing experience can be frustrating and unproductive for both.

There are many forms of blankets, coverings and pillows for use by a nursing woman. While traditional blankets and diapers have been used for privacy purposes, a blanket or diaper draped over the shoulder is cumbersome at best. To address physical comfort, women have resorted to the use of pads and pillows to "boost" the infant into a better position during nursing. There exists a need for a nursing pillow that provides the comfort and support for both the woman and child while also providing privacy protection options.

SUMMARY OF THE INVENTION

The article described herein is a nursing pillow that has two integral privacy panels, fasteners and a neck/carrying strap. The nursing pillow also can be folded unto itself and secured by the panels to provide a compact pillow and transport case that can be supported by the shoulder utilizing the carrying strap.

The nursing pillow itself has a generally U-shaped configuration with smooth contours on the outside and inside perimeter edges of the U-shape. Typically, the pillow filler material is enclosed within a removable pillow case or covering having the same essentially U-shaped configuration. The term pillow is generally used to refer to the pillow case (or covering) and filler material combination.

Two substantially triangular panels are attached to the outside perimeter of the pillow. The base of each substantially triangular panel is arcuate to match the contours of the outside perimeter of the pillow. Thus the two panels extend outwards from the outside perimeter of the pillow at the base of the substantially triangular pillows to the point of the triangles (the point being the origin of the acute angle opposite the base of the triangle). The dimension of the contoured bases of the two triangular panels allows the panels to contact and be attached to a majority of the outside perimeter of the pillow.

The pillow and attached panels can be envisioned laid flat on a surface for ease of understanding. The "pointed", non-pillow ends of the panels have fasteners attached. These are used (in one instance) to attach the panels to the neck strap during nursing. One side of the pillow, the bottom side, also has fasteners attached. These fasteners are used in converting the pillow into a self-contained carrying case and are used in conjunction with the panel fasteners. One of the panels essentially becomes an outside cover of the carrying case.

The bottom of the pillow would typically be against the lap of a woman during use. The infant would typically lie against the top side of the pillow during feeding. The top side of the pillow does not necessarily have fasteners although fasteners can be attached to the inside perimeter of the pillow to secure the neck strap (or carrying strap) to the pillow.

BRIEF DESCRIPTION OF DRAWINGS

The character of the invention, however, may be best understood by reference to one of its structural forms, as shown by the accompanying photographs, in which.

DETAILED DESCRIPTION OF THE PREFERRED EMBODIMENTS

Figure 1:
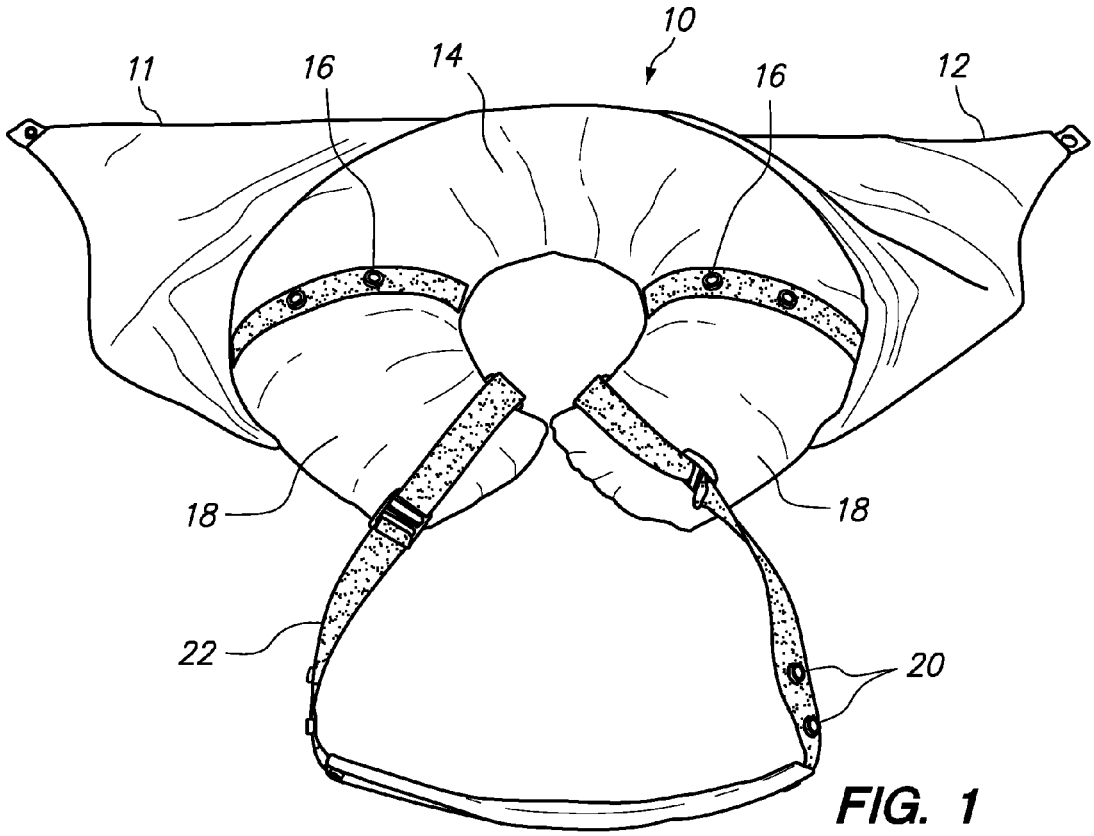
FIG. 1 is a view of the bottom side of the pillow and privacy panels showing the fasteners attached across the bottom side and a neck/carrying strap attached near the end of the opening in the U-shaped pillow.

Referring to FIG. 1, which best shows the general features of a preferred embodiment of the invention, the nursing pillow 10 with privacy panels 11, 12 and integrated carrying case is shown in a fully expanded position with the bottom side 14 of the pillow facing up. The pillow consists of a U-shaped configuration typically enclosed in a pillow case of the same configuration. Attached to the outside perimeter surface of the pillow are two privacy panels 11, 12 that are essentially triangular in shape. The base of each triangular-shaped panel is substantially arcuate to approximately match the shape of the outside perimeter of the pillow. Portions of the respective bases of the two panels can be in close proximity, if not actually against each other. The panel bases are typically attached to a substantial portion of the outside perimeter of the pillow.

Figure 1A:
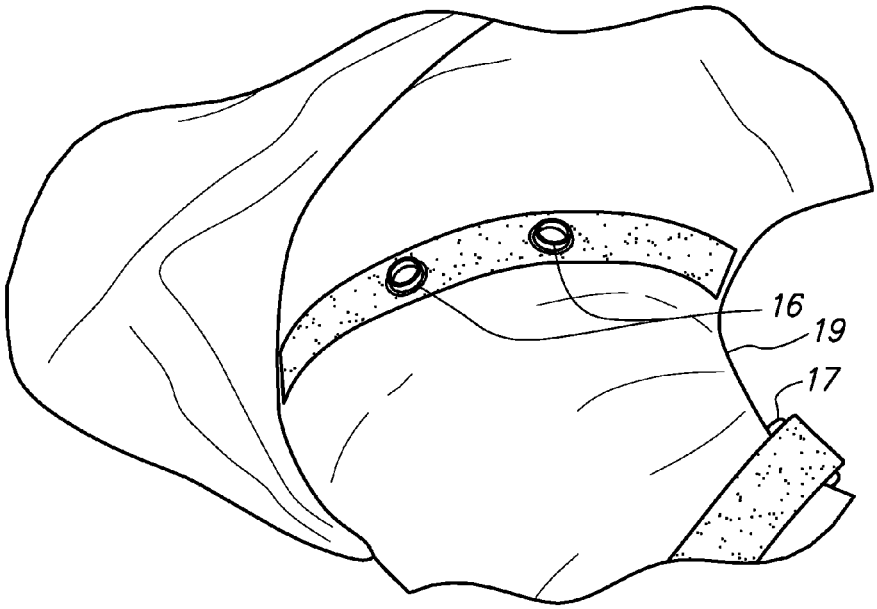
FIG. 1A is a close up view of the bottom side of the pillow showing the fasteners.

First fasteners 16 are connected to the bottom side of the pillow on both "legs" 18 of the U-shaped pillow. These particular fasteners are utilized when the pillow is folded into its case configuration. FIG. 1A shows a close-up of the fasteners 16 used to secure the "case" in position. Mating (second) fasteners on the non-pillow end of the panels attach to the pillow fasteners to secure the carrying case. Strap attachment means 17 are typically located on or near the inside perimeter surface 19 of the pillow as shown. All fastener and attachment means known to those skilled in the art are contemplated including, but not limited to, hooks, loops, clips, snaps, buttons, hooks and loops, pins, grommets, hooks and eyes, thread, etc.

Third fasteners 20 are attached to the strap 22. These fasteners are utilized when the woman is nursing and the strap functions as a "neck strap". The ends of the strap are removeably secured to the pillow and the strap is positioned around the woman's neck (not shown). Second fasteners 23 (labeled in FIG. 4) at or near the angle at the non-pillow end of each privacy panel can then be connected to the mating fasteners on the neck strap to secure the privacy panel in place while nursing.

Figure 2:
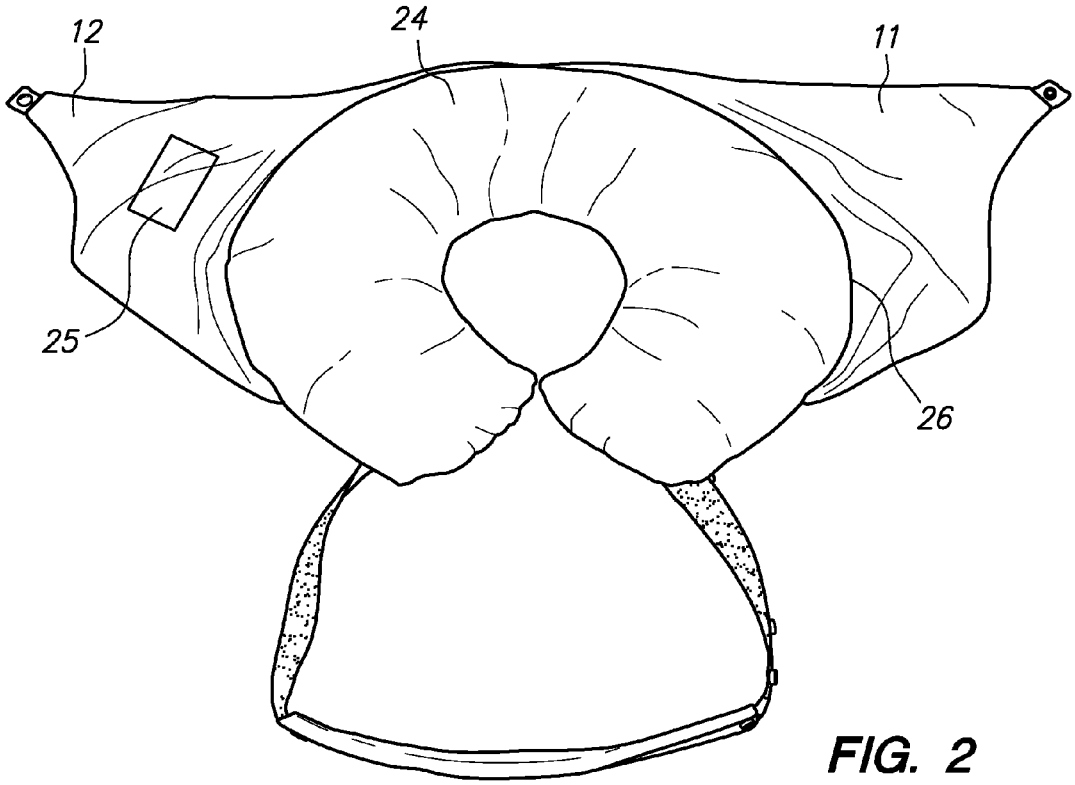
FIG. 2 is a view of the top side of the pillow ready for folding.

FIG. 2 illustrates the top side 24 view of the nursing pillow prior to folding. A storage component, e.g. a pocket 25 is shown on panel 12 in this view. As a first step prior to folding, the privacy panels 11, 12 can lay flat extending from the outside perimeter 26 of the pillow.

Figure 3:
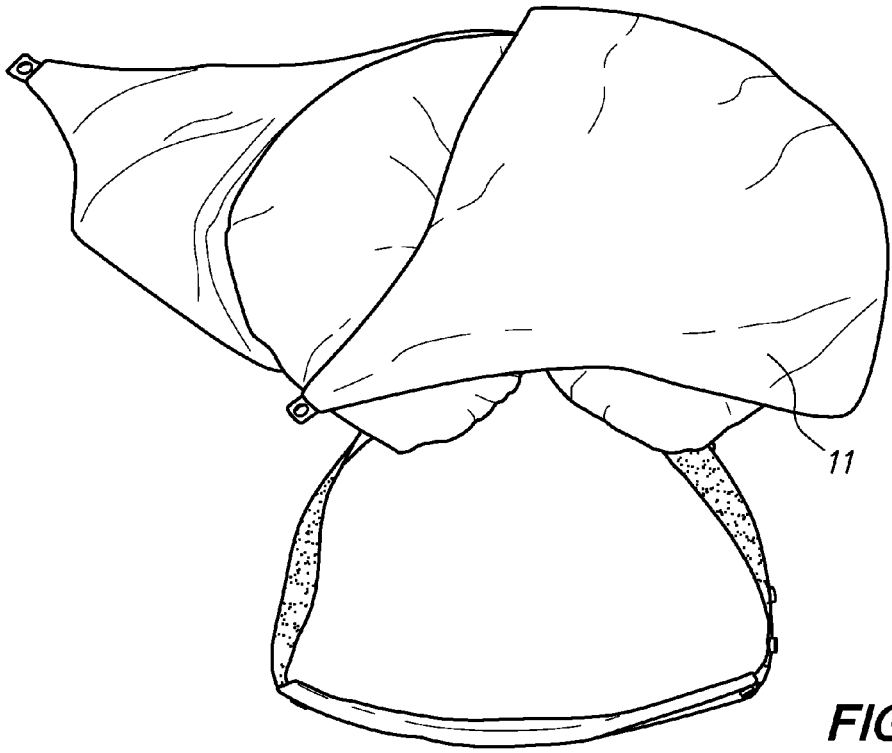
FIG. 3 shows a first panel folded over as a first step in enclosing the pillow in its integrated case.

FIG. 3 shows a first privacy panel 11 laid flat against the top side of the pillow. This is the second step in converting the pillow into its integrated carrying case.

Figure 4:
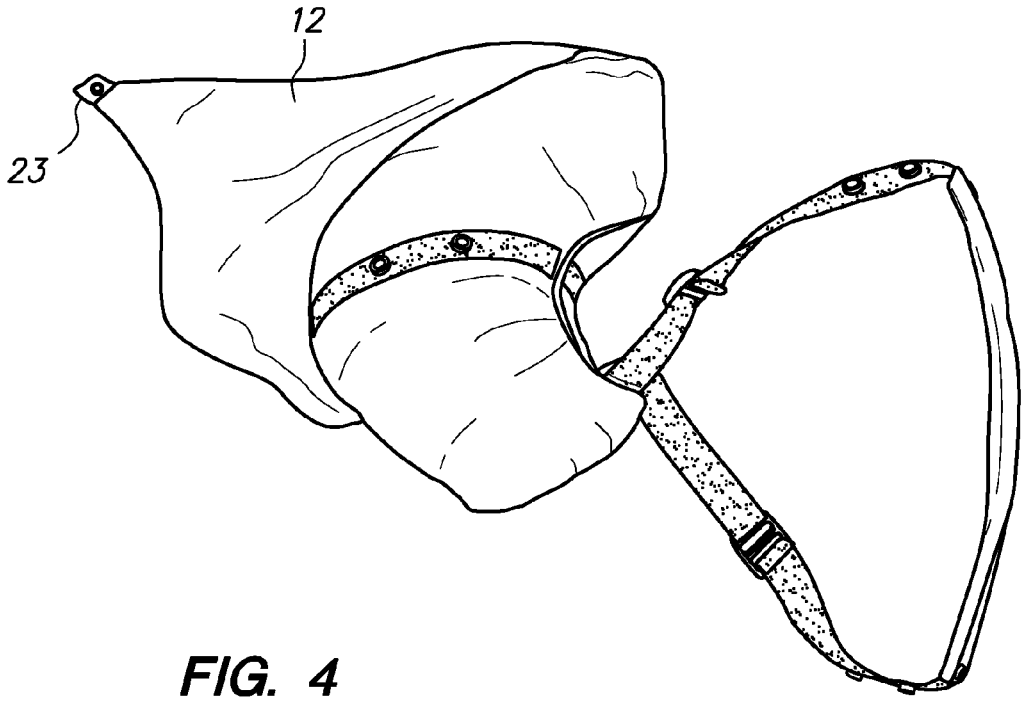
FIG. 4 shows one half of the pillow folded over as a second step in enclosing the pillow in its integrated case.

FIG. 4 illustrates the next step which entails folding the nursing pillow in half. It is important to note that the second privacy panel 12 should be clear of the fold at this point. The second panel 12 is then wrapped tightly around the body of the nursing pillow essentially pressing both halves of the pillow (or "legs" of the U-shape) together in a compact fashion. The fastener 23 on the end of the second panel is attached to the mating fastener (not shown) on the underside of the pillow.

Figure 5:
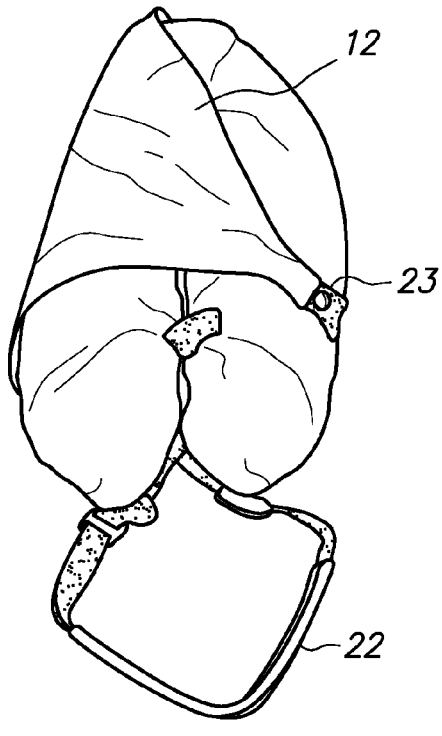
FIG. 5 shows the second panel folded over and attached with fasteners to fully enclose the pillow in its integrated case.

FIG. 5 shows the pillow fastened into its integrated carrying case. The strap 22 can be positioned over a shoulder for easy transport.

CONCLUSIONS, OTHER EMBODIMENTS, AND SCOPE OF INVENTION

The nursing pillow disclosed herein provides a convenient way for nursing mothers to breastfeed their children in non-private settings without sacrificing privacy. The pillow design provides comfort for both mother and child and the dual panels provide privacy protection for either or both breasts without the need to remove the neck strap or reposition the pillow itself. The integrated carrying case provides elegant functionality and further convenience.

The nursing pillow described herein utilizes a pillow insert within a snug-fitting, removable pillow case. All known pillow stuffing and cover materials are contemplated for use with the embodiments disclosed herein. The pillow shape should be approximately U-shaped but no constraints are made on the relative size of the "legs" of the U-shaped pillow. The edges of the pillow preferably are substantially smooth and arcuate to maximize comfort for both mother and child.

A wide variety of materials can be utilized to make the panels and all suitable material known to those skilled in the art is contemplated. Similarly, the strapping material and fasteners can encompass a wide variety of applicable material known and used by those skilled in the art.

While the material shown and described for use as a privacy panel is opaque throughout, this should not be considered as limiting. The scope encompasses all privacy panels that are substantially, but not necessarily totally, opaque over the entire panel area. Additionally, substantially triangular panels are defined to include all panels with wide base section relative to the area opposite the base section, whether that side opposite the base section is represented by a definite point or a non-point configuration.

In its broad form, an embodiment of the invention will comprise a substantially U-shaped pillow having a top side, a bottom side, a generally arcuate inside and outside perimeter and two substantially triangular-shaped panels attached on or near the outside perimeter of the pillow. Fasteners can be placed on the bottom side of the pillow and on the panels. An embodiment with a strap attached to the pillow can include fasteners on the strap. Fasteners on the end of the strap can be utilized to secure the strap to the pillow. Fasteners (not shown in the drawings) on or near the inside perimeter of the pillow can be in the form of, by way of example, zippers and the like for opening the pillow or case to access the pillow stuffing material.

Other examples of the invention will be apparent to those skilled in the art from a consideration of the specification or practice of the invention disclosed herein. It should be evident that this disclosure is by way of example and that various changes may be made by adding, modifying, or eliminating details without departing from the fair scope of the teaching contained in this disclosure. The invention is therefore not limited to particular details of this disclosure except to the extent that the following claims are necessarily so limited. Thus it is intended that the specification and examples be considered as illustrative only, with the true scope and spirit of the invention being indicated by the following claims.

We claim:

1. A substantially U-shaped pillow comprising
filler material, a pillow case, two leg sections,
a top surface, a bottom surface,
an inside perimeter section, an outside perimeter section,
said top surface attached to said bottom surface at least along the approximate midline of said inside perimeter section and along the midline of said outside perimeter section,
and two substantially triangular panels comprising a base section,
said substantially triangular panels attached at said base sections to the pillow approximately at the midline of said outside perimeter section.

2. The pillow of claim 1 wherein the base sections of said substantially triangular panels contact a majority of said outside perimeter section.

3. The pillow of claim 2 wherein the outside perimeter has a substantially arcuate shape.

4. The pillow of claim 3 wherein the base of each substantially triangular panel has a substantially arcuate shape.

5. The pillow of claim 1 further comprising at least one storage compartment.

6. The pillow of claim 5 wherein said at least one storage compartment is attached to a substantially triangular panel.

7. The pillow of claim 1 further comprising first fasteners attached to the two leg sections at the bottom surface.

8. The pillow of claim 7 wherein both substantially triangular panels further comprise second fasteners attached thereto.

9. The pillow of claim 1 further comprising a strap having two ends, wherein both ends are attached to the pillow.

10. The pillow of claim 9 wherein said strap is attached to the inside perimeter section.

11. The pillow of claim 9 wherein said strap further comprises third fasteners attached thereto.

* * * * *